US006981814B2

(12) United States Patent
Geardino et al.

(10) Patent No.: US 6,981,814 B2
(45) Date of Patent: Jan. 3, 2006

(54) CONTAINER FOR STORING AND DISPENSING FLOWABLE PRODUCTS

(75) Inventors: Glenn Robert Geardino, Red Bank, NJ (US); Manharbhai Kantibhai Patel, Saddlebrook, NJ (US); Barry Hutton, Northumberland (GB); Michael Corcoran, Northumberland (GB); William Heron, Newcastle upon Tyne (GB); Lou Ann Christine Vena, Scotch Plains, NJ (US); Melissa Jamie Miczewski, Rahway, NJ (US); Maxine Gayle Moore, Piscataway, NJ (US)

(73) Assignee: Redlon Consumer Products Corporation, New York, NY (US)

( * ) Notice: Subject to any disclaimer, the term of this patent is extended or adjusted under 35 U.S.C. 154(b) by 386 days.

(21) Appl. No.: 10/238,671

(22) Filed: Sep. 10, 2002

(65) Prior Publication Data

US 2004/0047674 A1 Mar. 11, 2004

(51) Int. Cl.
*B43K 5/00* (2006.01)

(52) U.S. Cl. ..... 401/205

(58) Field of Classification Search ..... 401/196, 401/202, 205, 261–263, 265, 266, 192
See application file for complete search history.

(56) References Cited

U.S. PATENT DOCUMENTS

| | | | | | |
|---|---|---|---|---|---|
| 2,034,137 | A | | 3/1936 | Fitz-Gibbon | 92/67.4 |
| 2,716,250 | A | * | 8/1955 | Deakers | 401/86 |
| 2,853,728 | A | | 9/1958 | Nadai | 15/134 |
| 3,036,328 | A | | 5/1962 | Schaich | 15/572 |
| 3,054,133 | A | | 9/1962 | Hublard | 15/565 |
| 3,072,953 | A | | 1/1963 | Bunke | 15/592 |
| 3,106,742 | A | * | 10/1963 | Schultz et al. | 401/202 |
| 3,108,314 | A | | 10/1963 | House | 15/566 |
| 3,121,906 | A | | 2/1964 | Hulsh | 15/592 |
| 3,132,370 | A | | 5/1964 | Capezzuto | 15/541 |
| 3,135,007 | A | | 6/1964 | Howell | 15/608 |
| 3,261,515 | A | * | 7/1966 | Luedtke | 222/520 |
| 3,756,732 | A | | 9/1973 | Stoffler | 401/202 |
| 3,930,792 | A | | 1/1976 | Alperin et al. | 8/10.1 |
| 4,747,720 | A | * | 5/1988 | Bellehumeur et al. | 401/205 |
| 4,752,147 | A | | 6/1988 | Persi | 401/126 |
| 4,931,066 | A | | 6/1990 | Grollier et al. | 8/410 |
| 5,018,894 | A | | 5/1991 | Goncalves | 401/202 |
| 5,051,016 | A | * | 9/1991 | Bengston | 401/213 |
| 5,230,579 | A | * | 7/1993 | Klawson et al. | 401/205 |
| D342,021 | S | | 12/1993 | Porta | D9/338 |
| D351,338 | S | | 10/1994 | Koptis | D9/309 |
| 5,577,851 | A | | 11/1996 | Koptis | 401/202 |

(Continued)

FOREIGN PATENT DOCUMENTS

| | | |
|---|---|---|
| EP | 312343 | 4/1989 |
| JP | 1-166704 | 6/1989 |

OTHER PUBLICATIONS

*Hair Color Compositions and Methods for Coloring Hair,* naming inventors Melissa Jamie Kellett–Miczewski, Lou Ann Christine Vena, and Saroja Narasimhan.

(Continued)

*Primary Examiner*—Gregory L. Huson
*Assistant Examiner*—Huyen Le
(74) *Attorney, Agent, or Firm*—Julie Blackburn

(57) ABSTRACT

A container for storing and dispensing flowable products comprising a receptacle for storing the flowable product, and a combination closure and applicator integral with the receptacle, where the closure is operable to open and close the receptacle and the applicator to apply the product directly to the desired surface; and a method for applying the cosmetic compositions to the desired surface using the container.

91 Claims, 7 Drawing Sheets

U.S. PATENT DOCUMENTS

| | | | | | |
|---|---|---|---|---|---|
| 5,589,177 | A | | 12/1996 | Herb | 424/401 |
| 5,688,831 | A | | 11/1997 | El-Nokaly | 514/938 |
| 5,702,712 | A | | 12/1997 | Wenke | 424/401 |
| 5,871,020 | A | * | 2/1999 | DeVone | 132/317 |
| 5,908,256 | A | * | 6/1999 | Bernstein | 401/205 |
| 5,931,973 | A | | 8/1999 | Malle | 8/431 |
| 5,961,664 | A | | 10/1999 | Anderson | 8/405 |
| 5,961,665 | A | | 10/1999 | Fishman | 8/406 |
| 5,972,322 | A | | 10/1999 | Rath | 424/70.11 |
| 6,030,138 | A | | 2/2000 | Losier | 401/266 |
| 6,106,578 | A | | 8/2000 | Jones | 8/406 |
| 6,231,259 | B1 | | 5/2001 | Murgida | 401/175 |
| 6,234,698 | B1 | | 5/2001 | De Laforcade | 401/175 |
| 6,238,653 | B1 | | 5/2001 | Narasimhan | 424/62 |
| 6,241,971 | B1 | | 6/2001 | Fox | 424/47 |
| 6,284,003 | B1 | | 9/2001 | Rose | 8/412 |
| 6,325,995 | B1 | | 12/2001 | El-Nokaly | 424/64 |
| 6,334,727 | B1 | | 1/2002 | Gueret | 401/47 |
| 6,547,471 | B1 | * | 4/2003 | Tucker et al. | 401/206 |
| 6,635,262 | B2 | | 10/2003 | Jourdan | 424/400 |
| 2003/0074746 | A1 | | 4/2003 | Fischer | 8/405 |

OTHER PUBLICATIONS

*Packaged Hair Color Compositions and Method for Coloring Hair,* naming inventors Melissa Jamie Kellett–Miczewski, Maxine Gayle Moore, Glenn Robert Geardino, Manharbhai, Kantibhai Patel, Lou Ann Christine Vena, Barry Hutton, Michael Corcoran, William Heron.

Journal of Society of Cosmetic Chemistry, vol. 36, pp. 1–16 (Jan./Feb.). Diffusion of Semipermanent Dyestuffs in Human Hair.

Clairol Loving Care, Color Crème Hair Color, Medium Brown, No. 765, package copy, circa Jan., 2000.

Revlon Professional, Cool Hue, Semi–Permanent Hair Color, package copy, circa Aug., 1989.

African Pride, AP–105, HiLites Color Boost, Semi–Permanent Color Enhancers, circa Jan. 2000.

Clairol XtremeFX, Color Shock, circa Jan. 2000.

Research Disclosure No. 452082, Dec. 2001. Hair Color Compositions.

* cited by examiner

CONTAINER FOR STORING AND DISPENSING FLOWABLE PRODUCTS

The invention is in the field of containers, particularly those for storing and dispensing flowable products. More particularly, the invention is in the field of containers for storing and dispensing flowable cosmetic products.

BACKGROUND OF THE INVENTION

Many cosmetic products are found in the flowable form including lipsticks, eyeshadow, blush, hair color, foundation, and the like. Such products are often sold in cylindrical containers where the cosmetic is stored in the cylindrical container and is applied to the lips with a doe foot applicator that is affixed to a cap/rod/applicator assembly. Liquid foundations are most often stored and dispensed from glass bottles. When color cosmetics such as eyeshadow and blush are found in the flowable form, they are stored and dispensed in either cylindrical containers with a cap/rod/applicator assembly, squeeze tubes, or the like.

Cosmetics companies are always searching for better and more efficient ways to store and dispense flowable cosmetic products. In particular, it is most desirable to sell such products in containers that both store and dispense the cosmetic from a single unit such that the storage container is also capable of dispensing the cosmetic right on the skin surface by drawing the dispensing portion of the container across the skin surface.

An object of the invention is to provide a cosmetic storage and dispensing container for flowable cosmetic products.

A further object of the invention is to provide a cosmetic storage and dispensing container in a single unit, e.g. where the closure is integral to the storage container and serves as an application surface as well.

It is a further object of the invention to provide a storage and dispensing container for flowable cosmetic composition that may be operated with one hand if desired

SUMMARY OF THE INVENTION

The invention is directed to a container for storing and dispensing flowable cosmetic products comprising (a) a receptacle for storing the cosmetic product, (b) a combination closure and applicator integral with the receptacle, said closure operable to open and close the receptacle and said applicator to apply cosmetic directly to a keratinous surface when placed in contact therewith.

The invention is further directed to a container for storing and dispensing flowable cosmetic products comprising (a) a deformable receptacle for storing the flowable product, (b) a combination closure and applicator integral with the receptacle, said combination closure and applicator further comprising a (i) base portion having a second orifice and a second channel, (ii) a closure operable to open and close the receptacle, said closure comprising a first orifice and a first channel, and (iii) an applicator, wherein the second orifice is connected to the second channel and the second channel is connected to the first channel and the first channel is connected to the orifice, and the orifice has an applicator thereon.

The invention is also directed to a method for applying flowable cosmetic products to a keratinous surface comprising storing the cosmetic product in a container comprising (a) a deformable receptacle for storing the flowable product, (b) a combination closure and applicator integral with the receptacle, said closure operable to open and close the receptacle and said applicator to apply the product directly to the desired surface when placed in contact therewith; opening the closure; deforming the receptacle by application of pressure to express the cosmetic from the receptacle onto the applicator; stroking the applicator surface across the keratinous surface to deposit the flowable cosmetic product thereon.

The invention is also directed to a method of applying a flowable semi-permanent or temporary hair color composition to the hair comprising storing the hair color in a container comprising (a) a receptacle, (b) a combination closure and applicator integral with the receptacle, said closure operable to open and close the receptacle and said applicator to apply the flowable hair color directly to the hair when placed in contact therewith; opening the closure; stroking the applicator surface across the hair to deposit the flowable hair color on the hair.

The invention is also directed to a method of applying a flowable lip cosmetic composition to the lips comprising storing the lip cosmetic composition in a container comprising (a) a receptacle, (b) a combination closure and applicator integral with the receptacle, said closure operable to open and close the receptacle and said applicator to apply the flowable lip cosmetic composition directly to the lips when placed in contact therewith; opening the closure; then stroking the applicator surface across the lips to deposit the flowable lip cosmetic composition on the lips.

The invention is also directed to a method of applying a flowable cosmetic composition to facial skin comprising storing the cosmetic composition in a container comprising (a) a receptacle, (b) a combination closure and applicator integral with the receptacle, said closure operable to open and close the receptacle and said applicator to apply the flowable cosmetic composition directly to the facial skin when placed in contact therewith; opening the closure; then stroking the applicator surface across the facial skin to deposit the flowable cosmetic composition on the facial skin.

The invention is also directed to a method of applying a flowable nail composition to the nails or cuticles comprising store the nail enamel in a container comprising (a) a receptacle, (b) a combination closure and applicator integral with the receptacle, said closure operable to open and close the receptacle and said applicator to apply the flowable nail composition directly to the nail when placed in contact therewith; opening the closure; then stroking the applicator surface across the nails or cuticles to deposit the flowable nail composition on the nails or cuticles.

In the most preferred embodiment of the invention the receptacle is deformable and the cosmetic found within is expressed from the receptacle through the combination closure and applicator and onto the desired keratinous surface by deforming or squeezing the receptacle. This in turn applies shear forces to the cosmetic found therein and causes it to be expressed out of the receptacle onto the applicator surface.

BRIEF DESCRIPTION OF THE DRAWINGS

FIG. 2 further illustrates the operation of the combination closure and applicator that opens and closes the container.

FIG. 7 shows the cosmetic container of the invention used to apply cosmetic to various types of keratinous surfaces such as skin, hair, nails.

DETAILED DESCRIPTION OF THE DRAWINGS

The term "flowable cosmetic product" when used herein means a cosmetic product that is capable of flowing either with or without application of shear force. More particularly, liquid products will generally flow very easily without application of shear force, while semi-solid or solid products may or may not be capable of flow without application of shear force. The cosmetic compositions suitable for use in the invention may be in the liquid, semi-solid, or even solid form provided that if they are in the semi-solid or solid form they will flow upon application of shear forces such as shaking, swirling, or applying pressure such as squeeze pressure to the container in which the produce is stored. Any semi-solid or solid cosmetic composition that will not flow upon application of shear forces is not suitable for use in the claimed container The term "cosmetic composition" or "cosmetic product" when used herein means any cosmetic product that can be directly applied to keratinous surfaces such as skin, hair, or nails, including creams, lotions, toners, astringents, cleansers, eye shadow, blush, mascara, eye liner, concealer, foundation, lipstick, lip liner, hair color, hair conditioner, nail enamel, nail conditioners, cuticle treatments, and the like. Particularly preferred is where the cosmetic composition is a liquid hair color composition, more particularly a semi-permanent or permanent hair color composition.

The term "keratinous surface" means bodily surfaces such as skin, hair, or nails.

The term "integral with receptacle" means that the combination closure and applicator together with the receptacle form a single unit that is capable of both storing and applying the cosmetic composition and that the closure is opened and closed as it is affixed to the container, without physically removing a cap or lid from the container, and wherein the closure also serves as an applicator for the cosmetic found within the receptacle.

Figure 1:
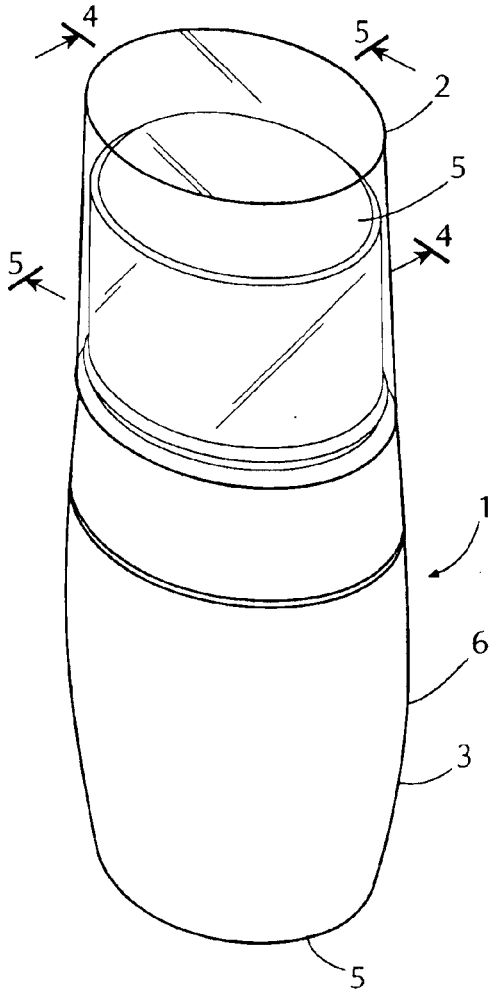
FIG. 1 is an illustration of the cosmetic container of the invention in the fully closed form.
Figure 2:
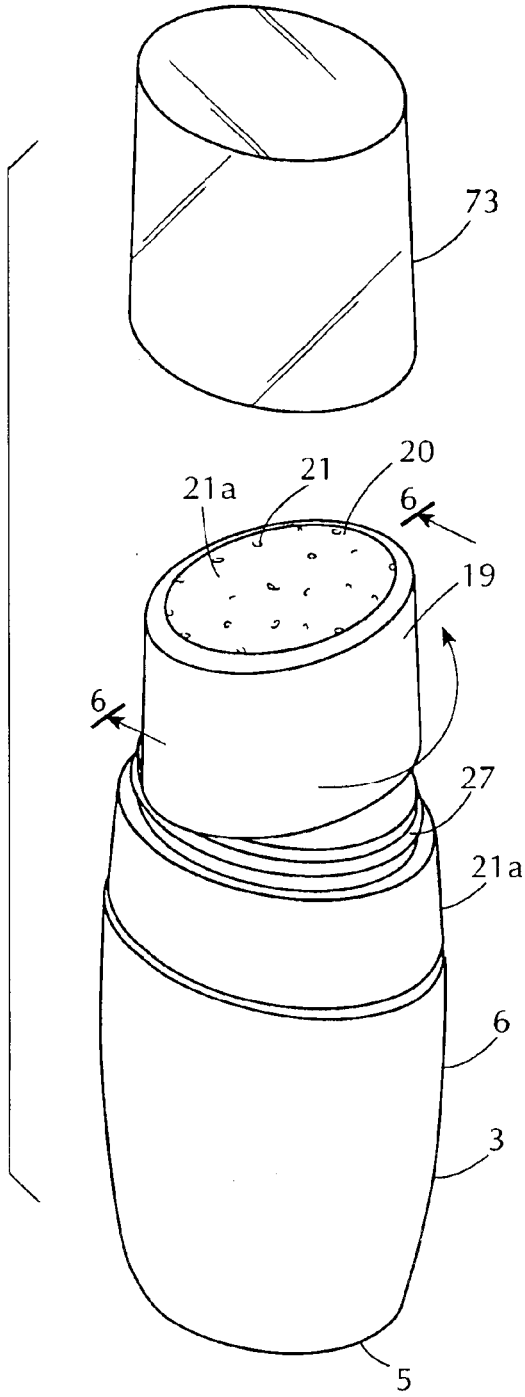
FIG. 2 is an exploded view of the cosmetic container of FIG. 1 showing the cap removed from the combination closure and applicator.

The term "deformable" means that the receptacle is capable of deformation upon squeezing. In other words, if some portion of the outer surface or wall of the receptacle is squeezed with the fingers, the receptacle will "give" or deform in response to the pressure exerted by the fingers. This pressure in turn applies shear forces to the cosmetic found therein and enhances its flow from the receptacle onto the applicator surface FIG. 1 illustrates the preferred embodiment of the container 1 in the fully closed position. The container 1 may be made of any material suitable for use with flowable cosmetic products including glass or plastic, but preferably the container is made from thermoplastic polymeric materials such as ABS, polyethylene, polypropylene, styrene, etc. Such thermoplastic materials have good compatibility with cosmetic compositions and are sturdy enough to withstand the stresses found in manufacturing, filling, and shipping of product. In the most preferred embodiment the receptacle is made of a deformable thermoplastic material that is capable of deformation upon application of pressure by the fingers.

Figure 3:
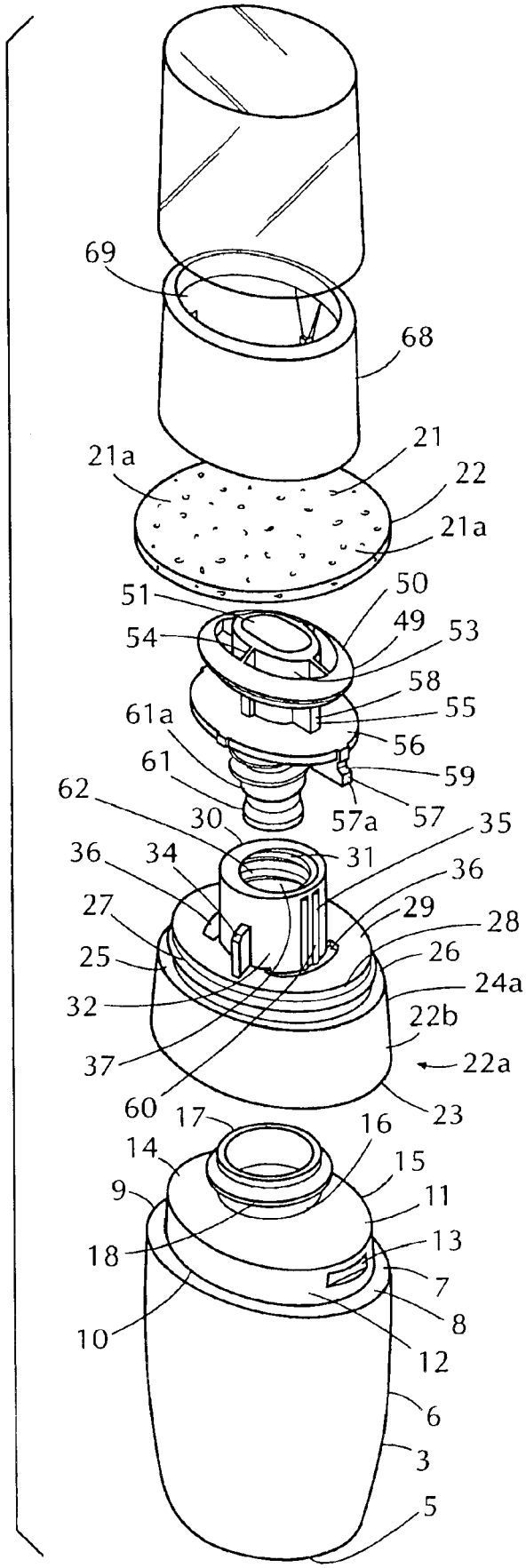
FIG. 3 is a fully exploded view of the cosmetic container of the invention showing the receptacle, the combination closure and applicator, and the cap
Figure 4:
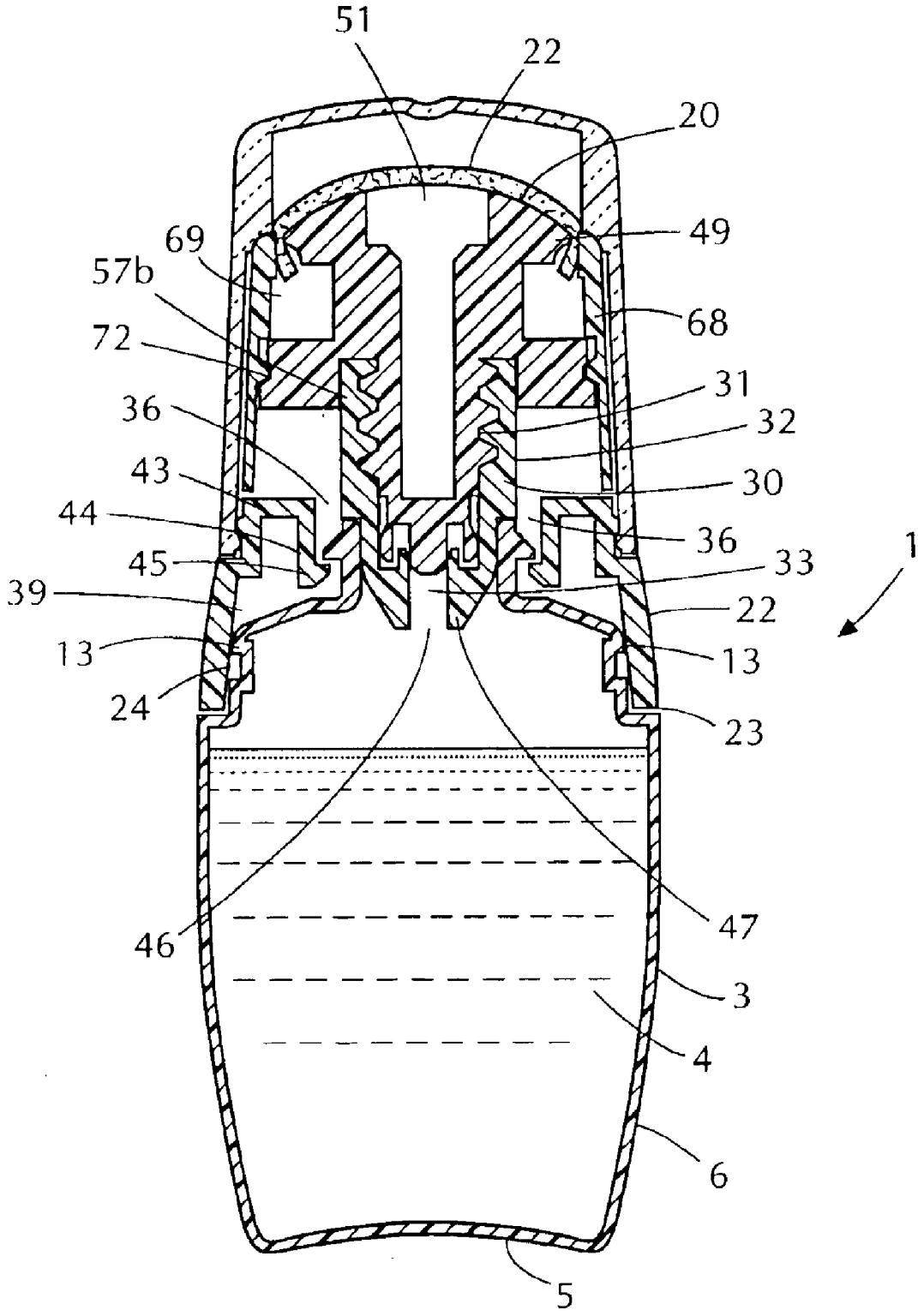
FIG. 4 is a side cut away view across 4—4 of FIG. 1 showing the cosmetic within the container.
Figure 6:
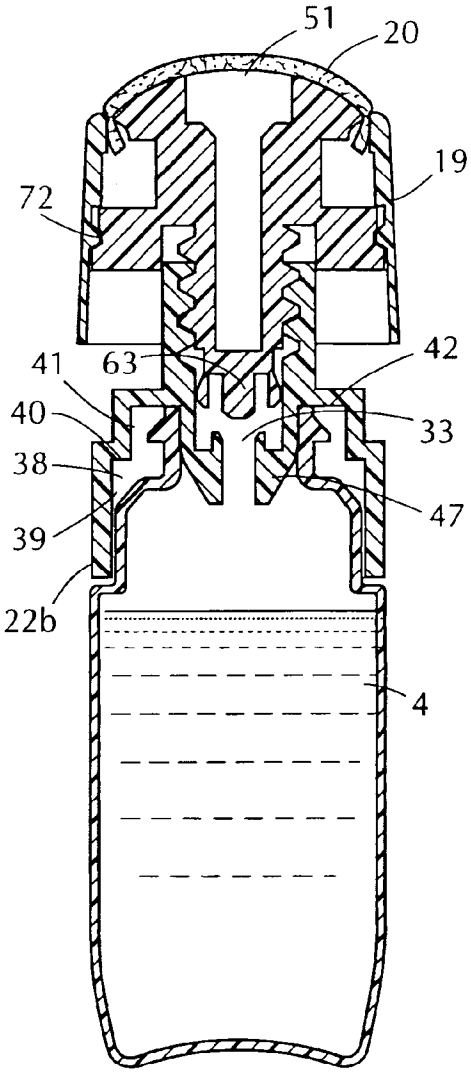
FIG. 6 is a side cut away view across 6—6 of FIG. 1 of the cosmetic container of the invention showing the cosmetic composition in the container and container in the open position.
Figure 5:
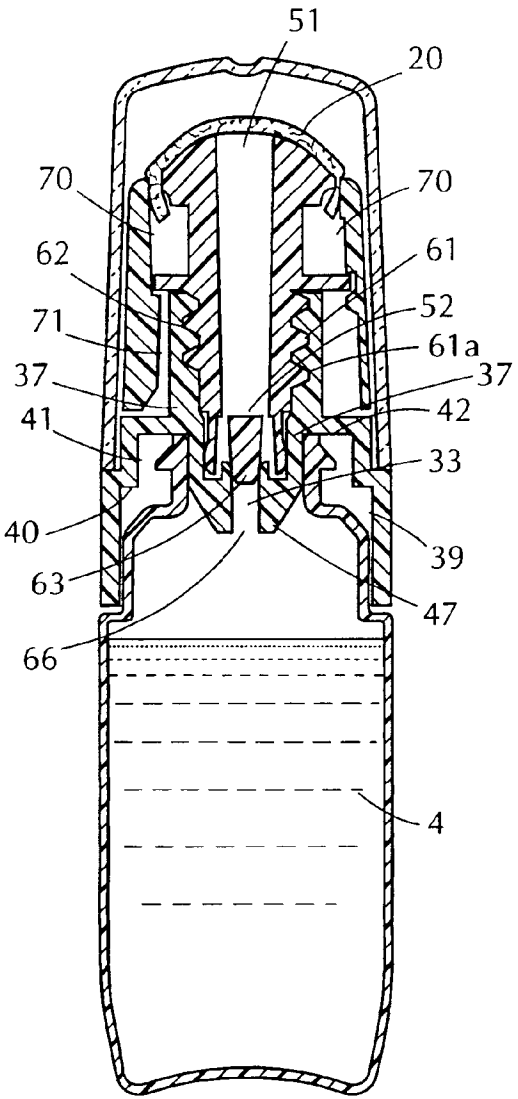
FIG. 5 is side cut away view across 5—5 of FIG. 1 of the cosmetic container of the invention showing the cosmetic composition in the container and the container in the closed position.

FIG. 3 contains an exploded view of the container 1, which contains a receptacle 3 for containing the cosmetic composition 4 (see FIGS. 4–6). Preferably the receptacle 3 has a base 5 and side walls 6 which are perpendicular to the base 5. While it is not necessary for the receptacle 3 to have a base 5 and side walls 6, this configuration is desirable as it enables the container 1 to be free standing which facilitates storage and use by the consumer. The base 5 may be circular, oval, square, rectangular, or any number of shapes with corresponding side walls 6. In the container 1 of FIGS. 1–6, the base 5 is oval and the side walls 6 are perpendicular thereto in a continuous longitudinal plane. This enables the container 1 to be free standing but also facilitates gripping of the container 1 by the consumer when applying the cosmetic composition 4 contained therein to the desired keratinous surface.

The receptacle 3 has a first shoulder 7 which comprises a circumferential rim or ledge 8 having an outer perimeter 9 flush with the side wall 6 of the receptacle 3 and an inner perimeter 10 which is slightly smaller in circumference than the outer perimeter 9. Generally, the distance between the outer perimeter 9 and the inner perimeter 10, or in other words, the width of the circumferential rim or ledge 8 ranges from about 0.0001 to about 1 inch, preferably about 0.1 to about 0.5 inch.

Preferably, affixed to, and on top of, the first shoulder 7 is a second shoulder 11. The second shoulder 11 comprises a side wall 12 which is perpendicular to the circumferential rim 8 and parallel to a plane which intersects the receptacle on the longitudinal axis. The side wall 12 of the second shoulder 11 may contain depressions 13 which will be further described herein. The second shoulder 11 further comprises a circumferential rim or ledge 14 which is perpendicular to the side wall 12 and which has an outer perimeter 15 and an inner perimeter 16 which abuts a threaded engaging means 17. Generally, the distance between the outer perimeter 15 and the inner perimeter 16, or in other words the width of the circumferential rim or ledge 14 ranges from about 0.0001 to about 1 inch, preferably from about 0.1 to about 0.5 inch. The threaded engaging means 17 contains threads or circumferential ridges 18 which facilitate engagement of the combination closure and applicator 19 for the receptacle 3.

The combination closure and applicator 19 comprises an applicator 20 which is preferably in the form of a porous material 21A such as an open celled foam. The porous material 21A has a plurality of holes or pores 21 through it such that the cosmetic product found within the receptacle 3 is capable of flowing through the pores 21. The porous material 21A may be made of a hard thermoplastic material, glass, or a soft thermoplastic material such as an open celled foam.

Generally the porous material 21A is in the form of a flat or concave planar surface 22 of a thickness ranging from about 0.0001 to about 1 inch having a plurality of holes or pores 21 through it such that the cosmetic composition 4 can flow through througgh the holes or pores 21 when the porous material 21A is contacted to the desired keratinous surface as depicted in FIG. 7.

Figure 7A:
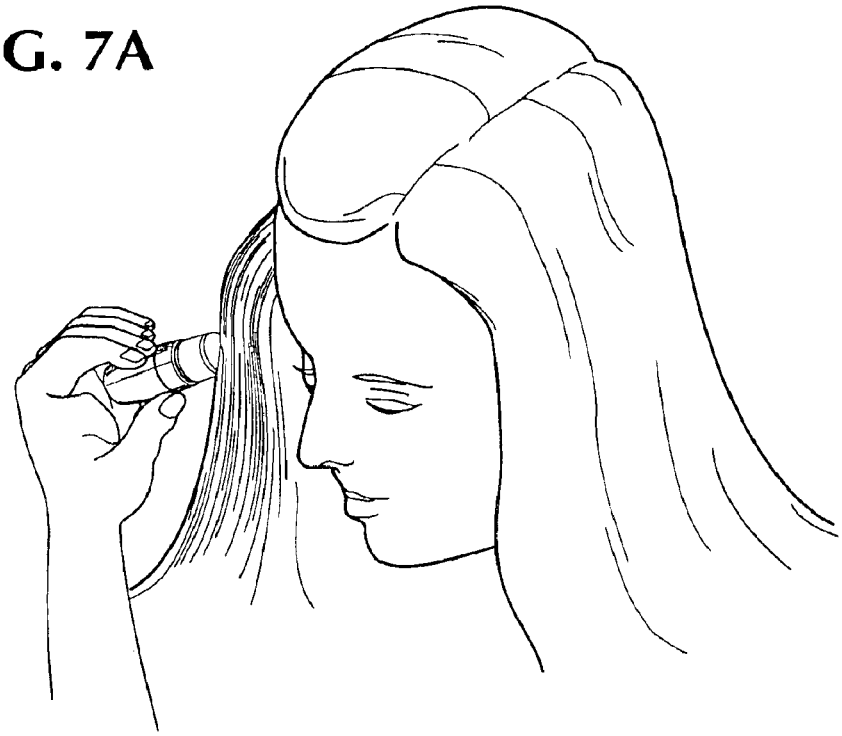
FIG. 7A shows the cosmetic container used to apply hair color or hair conditioner.

In particular, in FIG. 7A the cosmetic container of the invention is used to apply hair color or hair conditioner to the hair.

Figure 7B:
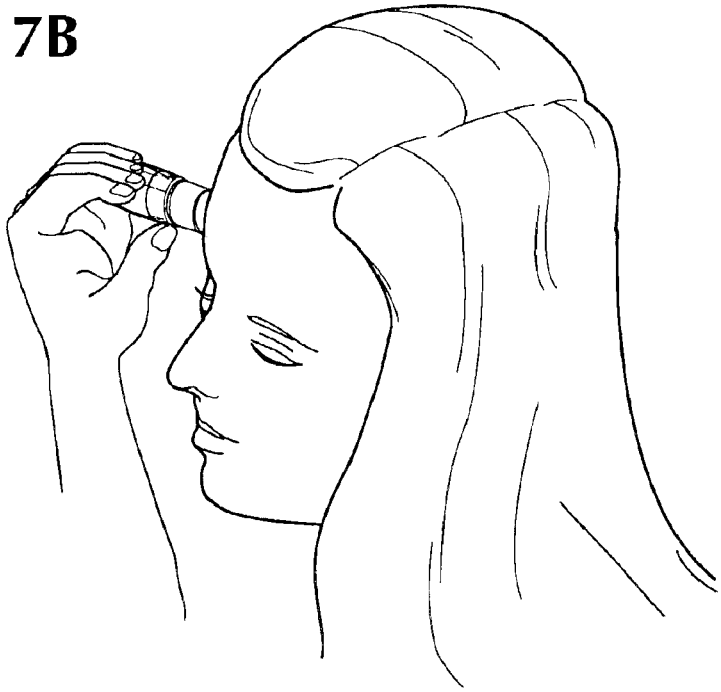
FIG. 7B shows the cosmetic container used to apply a cream or lotion or other similar facial cosmetic to the face.

In FIG. 7B the cosmetic container of the invention contains lotion, cream, foundation makeup or another similar type of cosmetic composition that is applied to the skin and is used to apply this composition to facial skin.

Figure 7C:
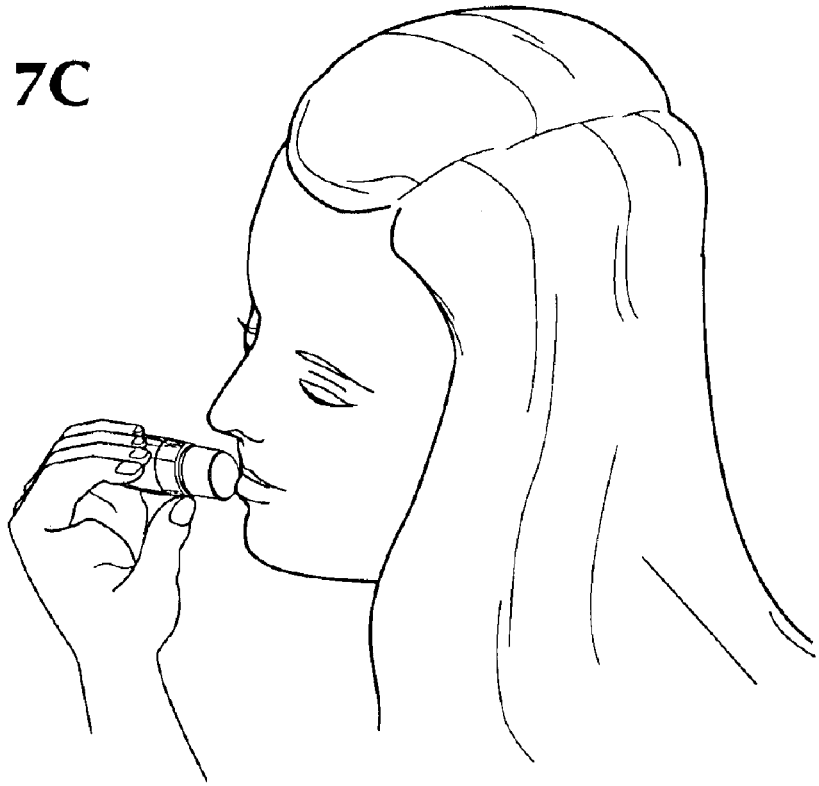
FIG. 7C shows the cosmetic container of the invention used to apply lip color to the lips.

In FIG. 7C the cosmetic container of the invention is used to apply a lip product such as lipstick, lip gloss, or lip conditioner to the lips.

Figure 7D:
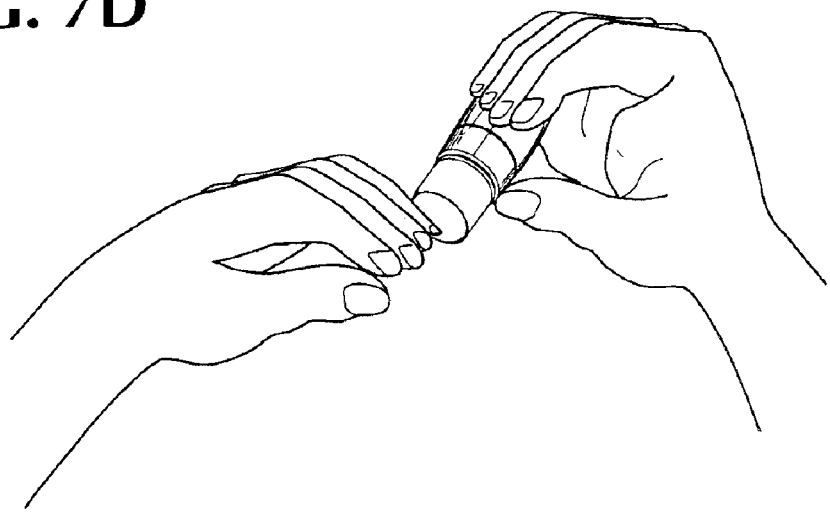
FIG. 7D shows the cosmetic container of the invention used to apply nail enamel to the nails.

In FIG. 7D the cosmetic container of the invention is used to apply a nail care product such as enamel, conditioner, or a cuticle composition to the nails or surrounding cuticle.

Preferably the porous material 21A is made from a foam-like or sponge material that is in the open-cell form thus permitting the cosmetic composition to flow through the interconnected cells within the foam from the receptacle to the keratinous surface when the porous material 21A is contacted with the desired keratinous surface.

The combination closure and applicator 19 comprises a comprises a base portion 22A which comprises a depending peripheral skirt 22B with a bottom edge 23 that abuts the circumferential rim or ledge 8 of the receptacle 3 when the base portion 22A is affixed to the receptacle 3 as best shown in FIGS. 1, 2, and 4–6. The width of the depending peripheral skirt 22B at the bottom edge 23 is generally the same as the width of the circumferential rim 8 such that when the base portion 22A is affixed to the receptacle 3 the depending peripheral skirt 22B and the side wall 6 of the receptacle 3 abut to form a smooth surface.

The depending peripheral skirt 22B has protrusions 24 (see FIG. 4) that are designed to mate with depressions 13 and further secure the base portion 22A to the receptacle 3.

Perpendicular to the depending peripheral skirt 22B and at the top surface thereof is a circumferential rim 24A having an outer perimeter 25 and an inner perimeter 26. The width of the circumferential rim 24A, or in other words the distance between the outer perimeter 25 and the inner perimeter 26 ranges from about 0.0001 to about 0.5 inches.

Abutting the inner perimeter 26 and affixed thereto are threaded engaging means 27. The threaded engaging means contain concentric rings 28, the reason for which will be further described herein.

The base portion 22A further comprises a platform 29 perpendicular to, and forming the top surface of the threaded engaging means 27.

Perpendicular to the platform 29 is a conduit 30 having an inner surface 31 and an outer surface 32 that provides a channel 33 through which the cosmetic product 4 can flow from the receptacle 3. The outer surface 32 of the conduit 30 contains a stop 34 in the form of a fin that extends perpendicularly from the outer surface 32 of the conduit 30.

Approximately about 90 degrees from the stop 34 on the outer surface 32 of the conduit 30 are two parallel ridges 35, the purpose of which will be further described herein.

Abutting the outer surface 32 of the conduit 30 where the conduit 30 meets the platform 29 are one or more, preferably two, openings 36 extending through the platform 29. The openings 29 are preferably about 180 degrees apart and preferably about 90 degrees from the stop 34 in the form of a fin that extends perpendicularly from the outer surface 32 of the conduit 30.

The two parallel ridges 35 are preferably situated on the same portion of the platform 29 as one of the two openings 36.

The conduit 30 is secured to the platform 29 in the areas 37 where the openings 36 are not found and such areas 37 are preferably about 90 degrees apart.

The base portion 22A has an inner surface 38 (see FIGS. 6 and 8A) in the form of a side wall 39 and inner shoulder 40 and an inner neck 41 affixed to the inner shoulder 40. Perpendicular to the inner neck 41 is at least one, preferably two, first under surfaces 42 that form the interior surface of areas 37.

The first under surfaces 42 connect with the inner surface 31 of conduit 30.

Figure 8A:
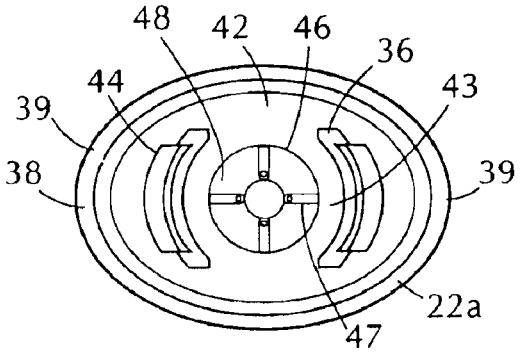
FIG. 8A is a bottom plan view of base portion 22A.
Figure 8B:
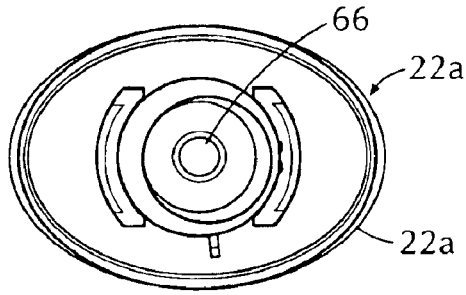
FIG. 8B is a top plan view of base portion 22A.

Perpendicular to the first under surfaces 42 are at least one, preferably two, second under surfaces 43 which are best seen in FIG. 8A. Said second under surfaces 43 have depending side walls 44 (at least one, preferably two) with at least one, preferably two, abutments 45 (see FIG. 4) designed to mate with the threaded engaging means 17 of the receptacle 3 to secure base portion 22A to the receptacle 3.

On the other side of the depending side wall 44 and abutment 45 are openings 36.

The channel 33 extends through inner surface 31 of conduit 30 and through a plug 46 having a plurality, preferably four, pegs 47 around the channel 33 opening which is the second orifice 66. The four pegs 47 are preferably arranged about 90 degrees apart on the platform 48 of the plug 46 and surrounds the second orifice 66.

When base portion 22A is affixed to receptacle 3 the cosmetic composition 4 flows through orifice 66 in the plug 46, through channel 33 and conduit 30.

In addition to the base portion 22A, the combined closure and applicator 19 also comprises a closure 49.

The closure 49 comprises a top surface 50 containing an orifice 51 which is contiguous with a channel 52 (see FIG. 5) that mates with channel 33 to form one continuous channel from the receptacle to the outer surface of the applicator.

The top surface 50 of the closure 49 contains reservoirs 53 for containing cosmetic product 4.

When the cosmetic product 4 is dispensed from the receptacle 3 through orifice 66 and channel 33, and channel 52, it flows out of orifice 51 and impregnates porous material 21A by flowing through pores 21 onto the surface of porous material 21A.

In the event excess cosmetic product 4 flows out of orifice 51 it will be preferentially taken up in the reservoirs 53 where it may be temporarily stored while the user is applying the cosmetic product to the desired keratinous surface. Capillary action and gravity will draw the excess cosmetic product 4 out of the reservoirs 53 when the container 1 is used to apply cosmetic composition 4 to the desired keratinous surface.

When the container is stored in an upright state, the excess cosmetic product 4 that flowed out of the orifice 51 will be stored in the reservoirs 53. The reservoirs 53 enable a more even application and distribution of the cosmetic product 4 onto the desired keratinous surface.

Preferably, the top surface 50 of the closure 49 contains a plurality of reservoirs 53, more preferably about four.

The top surface 50 of the closure 49 is preferably in the form of a convex dome 54 affixed to a neck portion 55.

Affixed to the lower edge of neck portion 55 is an intermediate platform 56 having a plurality of downwardly extending fins 57. Preferably there are two downwardly extending fins 57 that are spaced about 180 degrees apart.

It may be desirable for the neck portion 55 to have one or more extending walls 58 for the purpose of bracing the convex dome 54.

Downwardly extending fins 57 are designed to mate with parallel ridges 35 on the outer surface 32 of conduit 30. In particular one downwardly extending fin 57 is of a cross sectional width 59 such that it is capable of seating within the space 60 between the parallel ridges 35.

Affixed to the lower portion of intermediate platform 56 is a cylindrical portion 61 having threaded engaging means 61A on the external surface thereof, which are designed to mate with the inner surface 31 of conduit 30. In particular, the inner surface 31 of conduit 30 has threads or engaging means 62 which mate with engaging means 61A Channel 52 runs from orifice 51 through the convex dome 54 and neck portion 55, intermediate platform 56 and through cylindrical portion 61 where it meets channel 33 and then opens into the receptacle 3 through second orifice 66.

Figure 8C:
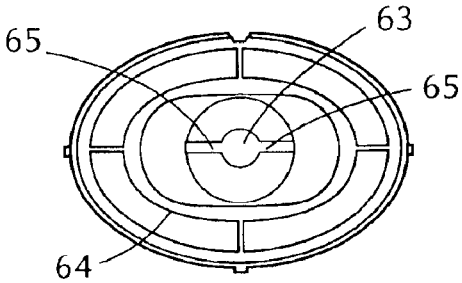
FIG. 8C is a top plan view of closure 49.
Figure 8D:
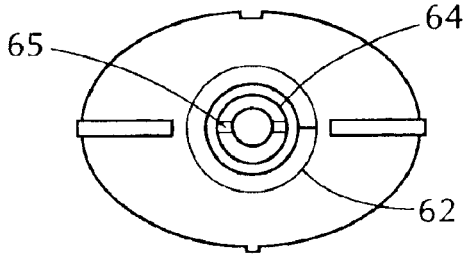
FIG. 8D is a bottom plan view of closure 49.

FIGS. 8C and 8D depict closure 49. FIG. 8C is a top plan view of the closure 49 looking into orifice 51 down through channel 52. At the very end of the channel 52 in the lower portion of the cylindrical portion 61, there is a small peg 63 which is suspended from either side of the inner surface 64 of the cylindrical portion 62 by a plurality, preferably two, cross bars 65.

FIG. 8D, a bottom plan view of the closure 49 also shows the peg 63 suspended from either side of the inner surface 64 of the cylindrical portion 62 by two cross bars 65. The peg 63 is of a size and shape sufficient to close the second orifice 66 found at the lower end of channel 33 in the base portion 22A when the closure 49 is in the closed position.

Closure 49 is opened and closed by rotating closure 49 in a clockwise direction to cause one of the downwardly extending fins 57 to seat in the space 60 between parallel ridges 35. When it is desired to open the container, closure 49 is rotated in a counterclockwise direction so that the other downwardly extending fin seats in the space 60 between parallel ridges 35. Thus, the parallel ridges 35 serve as stops so that the consumer knows that when one downwardly extending fin 57 is seated in the space 60, there is an audible click which indicates that the closure has been released and the cosmetic product 4 in the receptacle can now be applied. Similarly, when the other downwardly extending fin 57 is seated in the space 60 another audible click is heard which indicates to the consumer that the peg 63 has blocked orifice 66 to close the container such that the cosmetic product 4 found in the receptacle can no longer be dispensed from the receptacle.

The combination closure and applicator further comprises an applicator portion. In particular, porous material 22A is affixed to the convex dome 54 using a circumferential ring 68 which fits snugly over closure 49. The inner surface 69 of circumferential ring 68 contains two depressions 70 that provide a seat for the exterior projections 57A on downwardly extending fins 57 on intermediate platform 56. When the exterior projections 57A of downwardly extending fins 57 are seated in depressions 70, the concumferential ring 68 fits snugly onto closure 49 and the circumferential ring 68 may be rotated in the clockwise direction and it will cause closure 49 to close as peg 63 closes second orifice 66.

The downwardly extending fins 57 have an inner surface 57B that engages with the space 60 between parallel ridges 35 while the exterior projections 57A of the downwardly extending fins 57 seats in the depressions 70 found on the inner surface 69 of circumferential ring 68.

The inner surface 69 of circumferential ring 68 also contains a protrusion 71 preferably in the form of a rectangle that mates with a slight depression 72 on the exterior projections 57A of the intermediate platform 56.

Porous material 22A is affixed to the closure 49 by layering it over the top surface 51 and using circumferential ring 68 to hold it in place as best depicted in FIG. 4. More particularly, circumferential ring 68 compresses the porous material 22A to provide a seal or barrier around its perimeter to prevent leakage.

Preferably container 1 contains a cap 73 (FIGS. 1 and 2) which fits over closure 49 and base portion 22A. If desired cap can be hermetically sealed to prevent evaporation of the cosmetic product 4 found in the receptacle 3.

As depicted in FIG. 7, the container can be used to store and apply a wide variety of flowable products including cosmetic compositions to keratinous surfaces such as skin, hair and nails.

The container is used by removing the cap and opening the closure by rotating in the counterclockwise direction, stroking the porous material over the desired surface with the container held in a manner that permits the flowable cosmetic to flow via gravity from the receptacle through the channels and out of orifice and onto the porous material when the closure is in the open position. After completing cosmetic application, the closure is moved to the closed position by rotating the closure in a clockwise manner, the cap is placed on the container and the container is stored in the usual manner. While in the preferred embodiment of the invention the closure is rotated to open the container, the closure can also be raised and lowered to remove the peg from the orifice and thereby open and close the container. It is intended that the claimed invention cover this type of an "up-down" closure in addition to a opening by rotation type closure. Further, the container provides a single unit that can store and apply the cosmetic composition without physically removing caps or lids. If desired, the container can be operated with one hand. The cosmetic container of the invention is capable of applying cosmetics to the desired surfaces by use of gravity (when the container is held with the applicator downwardly when applying to the desired keratinous surface) and/or capillary action (when cosmetic product within the reservoirs or in the receptacle is sucked out of the reservoirs by electrostatic attraction to the keratinous surface), or by shear forces by deforming the receptacle to squeeze the cosmetic out. This means that pumps, sprayers, or tubes, are eliminated which in turn reduces expense, and the difficulties inherent in such devices. In one embodiment of the invention, using gravity or capillary action as the method of causing flow of cosmetic out of the container onto the desired surface greatly simplifies the application of cosmetic. Further, the integral combined closure and applicator ensures that the cosmetic will flow from the receptacle via gravity or capillary action only when the closure is in the open position. In the preferred embodiment of the invention, the cosmetic is expressed from the receptacle by application of shear force through deformation of a receptacle which is deformable upon application of pressure as with pressure applied with the fingers. The application of the cosmetic using gravity, capillary action, or shear forces distinguishes the claimed invention and method from the prior art because no pumps or other internal mechanisms are required to express the cosmetic from the receptacle. Indeed, one benefit of the claimed container is that it expresses and applies liquid from a receptacle without use of a pump, aerosol spray, or similar type of internal mechanism.

While the invention has been described in connection with the preferred embodiment, it is not intended to limit the scope of the invention to the particular form set forth but, on the contrary, it is intended to cover such alternatives, modifications, and equivalents as may be included within the spirit and scope of the invention as defined by the appended claims.

We claim:

1. A container for storing and dispensing flowable products comprising (a) a receptacle for storing the flowable product, wherein the receptacle has a first shoulder comprising a circumferential rim having an outer perimeter flush with the side wall of the receptacle and an inner perimeter which is smaller in circumference than the outer perimeter, and (b) a combination closure and applicator comprising a base portion comprising a depending peripheral skirt having a bottom edge and wherein the width of the bottom edge of the depending peripheral skirt is the same as the width of the circumferential rim of the first shoulder of the receptacle, and a closure and an applicator which is integral with the receptacle, said closure operable to open and close the receptacle and said applicator to apply the product directly to the desired surface when placed in contact therewith.

2. The container of claim 1 wherein the flowable product is a cosmetic product.

3. The container of claim 2 wherein the desired surface is a keratinous surface.

4. The container of claim 2 wherein the receptacle is made of a deformable thermoplastic material.

5. The container of claim 4 wherein the flowable cosmetic product is a semi-solid or solid that flows upon application of shear force by deforming the receptacle upon application of pressure.

6. The container of claim 2 wherein the receptacle is a bottle.

7. The container of claim 2 wherein the flowable cosmetic product is a liquid.

8. The container of claim 2 wherein the receptacle for storing the flowable cosmetic product has a base and side walls.

9. The container of claim 8 wherein the base is circular or oval.

10. The container of claim 9 wherein the side walls are perpendicular to the base in a continuous longitudinal plane.

11. The container of claim 1 wherein the circumferential rim has a diameter of about 0.1 to about 0.5 inch.

12. The container of claim 11 containing a second shoulder affixed to and on top of the first shoulder.

13. The container of claim 12 wherein the second shoulder comprises a side wall perpendicular to a plane which intersects the receptacle on the longitudinal axis.

14. The container of claim 13 wherein the side wall of the second shoulder contains depressions.

15. The container of claim 12 wherein the second shoulder further comprises a circumferential rim which is perpendicular to the side wall of the second shoulder.

16. The container of claim 15 wherein the circumferential rim of the second shoulder has an outer perimeter and an inner perimeter which abuts a threaded engaging means.

17. The container of claim 16 wherein the circumferential rim of the second shoulder has a diameter of about 0.1 to 0.5 inch.

18. The container of claim 16 wherein the threaded engaging means contains circumferential ridges.

19. The container of claim 1 wherein the applicator is in the form of a porous material.

20. The container of claim 19 wherein the porous material has a plurality of holes through which the flowable cosmetic product will flow.

21. The container of claim 20 wherein the porous material is made of a hard thermoplastic material or glass.

22. The container of claim 20 wherein the porous material is made of a soft thermoplastic material.

23. The container of claim 22 wherein the soft thermoplastic material is an open celled foam.

24. The container of claim 23 wherein the porous material is in the form of a flat planar surface.

25. The container of claim 1 where the bottom edge of the depending peripheral skirt is seated on the circumferential rim of the first shoulder.

26. The container of claim 1 wherein the receptacle contains a first shoulder, and a second shoulder with a side wall, and the side wall of the second shoulder contains depressions, and wherein the depending peripheral skirt has protrusions, and the protrusions of the depending peripheral skirt mate with the depressions on the side wall of the second shoulder of the receptacle.

27. The container of claim 1 wherein the depending peripheral skirt contains a circumferential rim perpendicular to the depending peripheral skirt and on the top surface thereof, said circumferential rim having an outer perimeter and an inner perimenter wherein the inner perimeter is smaller than the outer perimeter.

28. The container of claim 27 further comprising threaded engaging means abutting the inner perimeter and affixed thereto.

29. The container of claim 28 wherein the threaded engaging means containing concentric rings.

30. The container of claim 1 wherein the base portion further comprises a platform perpendicular to and forming the top surface of the threaded engaging means.

31. The container of claim 30 wherein the platform comprises a conduit and the conduit is perpendicular to the platform and has an inner surface and an outer surface.

32. The container of claim 31 wherein the conduit provides a channel through which the cosmetic product can flow from the receptacle.

33. The container of claim 32 wherein the conduit comprises a stop in the form of a fin that extends perpendicularly from the outer surface of the conduit.

34. The container of claim 32 wherein the outer surface of the conduit comprises two parallel ridges.

35. The container of claim 31 wherein platform contains two openings extending through the platform and the openings abut the outer surface of the conduit.

36. The container of claim 35 wherein the openings are about 180 degrees apart.

37. The container of claim 36 wherein the conduit comprises a stop in the form of a fin that extends perpendicularly from the outer surface of the conduit, and wherein the fin is situated about 90 degrees from one of the two openings.

38. The container of claim 37 wherein the two parallel ridges are situated on the same portion of the platform as at least one of the two openings.

39. The container of claim 35 wherein the conduit is secured to the platform in at least two areas.

40. The container of claim 39 wherein the wherein the base portion further comprises at least one second under surface wherein said second under surface comprises at least one depending side wall having at least one abutment.

41. The container of claim 40 wherein the second under surface comprises two depending side walls each having one abutment.

42. The container of claim 40 where the receptacle comprises threaded engaging means and the abutment on the depending side wall of the second under surface mates with the threaded engaging means on the receptacle to secure the base portion to the receptacle.

43. The container of claim 31 wherein the conduit contains a channel and the channel extends through the inner surface of the conduit.

44. The container of claim 43 wherein the conduit has an opening and around the channel opening is a plug.

45. The container of claim 44 wherein there is a plurality of pegs around the channel opening on the plug.

46. The container of claim 45 where there are four pegs and the pegs are about 90 degrees apart.

47. The container of claim 1 wherein the base portion has an inner surface in the form of a sidewall, an inner shoulder, and an inner neck affixed to the inner shoulder.

48. The container of claim 47 wherein the base portion further comprises at least one first under surface which forms the interior surface of the areas where the conduit is secured to the platform.

49. The container of claim 48 wherein the under surface connects with the inner surface of the conduit.

50. The container of claim 1 wherein the closure comprises a top surface containing an orifice, and a channel.

51. The container of claim 50 wherein the top surface of the closure contains a plurality of reservoirs for containing cosmetic product.

52. The container of claim 51 wherein the top surface of the closure contains four reservoirs.

53. The container of claim 51 wherein the convex dome is affixed to a neck portion.

54. The container of claim 53 wherein the neck portion comprises a lower edge and affixed to the lower edge is a intermediate platform.

55. The container of claim 54 wherein the intermediate platform has a plurality of downwardly extending fins.

56. The container of claim 55 wherein there are two downwardly extending fins and said fins are spaced about 180 degrees apart.

57. The container of claim 56 wherein the base portion comprises a conduit with an outer surface and on the outer surface there are two parallel ridges, and wherein downwardly extending fins are designed to mate with parallel ridges on the outer surface of the conduit.

58. The container of claim 54 wherein the neck portion has one or more extending walls.

59. The container of claim 50 wherein the base portion contains a channel and channel in the closure mates with the channel in the base portion to permit the cosmetic composition to flow out the orifice in the closure.

60. The container of claim 50 wherein the top surface of the closure is a convex dome.

61. The container of claim 1 wherein the closure comprises a top surface, a neck portion, an intermediate platform, and a cylindrical portion.

62. The container of claim 61 wherein the cylindrical portion has threaded engaging means thereon.

63. The container of claim 62 wherein the base portion comprises a conduit having an inner surface, said inner surface having threaded engaging means, and wherein the threaded engaging means on the cylindrical portion of the closure mate with the threaded engaging means on the inner surface of the conduit when the closure is affixed to the base portion.

64. The container of claim 61 wherein the closure has an orifice and a channel having an inner surface, and at the end of the channel there is a peg suspended from the sides of the channel inner surface.

65. The container of claim 64 wherein the peg is suspended from the sides of the channel inner surface by two cross bars.

66. The container of claim 65 wherein the base portion comprises a channel and a second orifice, and the peg is of a size and shape sufficient to close the second orifice.

67. The container of claim 65 wherein the base portion comprises a conduit having outer surface and on the outer surface thereof are two parallel ridges having a space therebetween, and the closure comprises an intermediate platform having two downwardly extending fins, a channel, and a second orifice, and the peg closes the second orifice when the closure is rotated in a clockwise direction to cause one of the downwardly extending fins to seat in the space between the two parallel ridges.

68. The container of claim 67 wherein an audible click is heard by the consumer when one of the downwardly extending fins is seated in the space between the two parallel ridges.

69. The container of claim 1 wherein the combination closure and applicator further comprises a circumferential ring.

70. The container of claim 69 wherein the closure comprises a convex dome and the applicator is affixed to the convex dome with the circumferential ring.

71. The container of claim 70 wherein the circumferential ring contains two depressions on the inner surface thereof.

72. The container of claim 69 wherein the closure comprises an intermediate platform having two downwardly extending fins and the two depression on the circumferential ring mate with the two downwardly extending fins when the circumferential ring is affixed to the closure.

73. The container of claim 69 wherein the circumferential ring contains a plurality of protrusions on the inner surface thereof.

74. The container of claim 1 further comprising a cap.

75. The container of claim 74 wherein the cap hermetically seals the container.

76. A method for applying flowable cosmetic products to a keratinous surface comprising storing the cosmetic product in the container of claim 1 opening the closure and deforming the receptacle by application of pressure to express the cosmetic from the receptacle onto the applicator; stroking the applicator surface across the keratinous surface to deposit the flowable cosmetic product thereon.

77. A method of applying a flowable semi-permanent or temporary hair color composition to the hair comprising storing the hair color in the container of claim 1 opening the closure and stroking the applicator surface across the hair to deposit the flowable hair color on the hair.

78. A method of applying a flowable lip cosmetic composition to the lips comprising storing the lip cosmetic composition in the container of claim 1 opening the closure and then stroking the applicator surface across the lips to deposit the flowable lip cosmetic composition on the lips.

79. A method of applying a flowable cosmetic composition to facial skin comprising storing the cosmetic composition in the container of claim 1 opening the closure and then stroking the applicator surface across the facial skin to deposit the flowable cosmetic composition on the facial skin.

80. A method of applying a flowable nail composition to the nails or cuticles comprising store the nail enamel in the container of claim 1 opening the closure and then stroking the applicator surface across the nails or cuticles to deposit the flowable nail composition on the nails or cuticles.

81. A container for storing and dispensing flowable products comprising (a) a receptacle for storing the flowable product, and (b) a combination closure and applicator comprising a base portion, a closure and an applicator which is integral with the receptacle, said base portion comprising a depending peripheral skirt, said closure operable to open and close the receptacle and said applicator to apply the product directly to the desired surface when placed in contact therewith; wherein the receptacle contains a first shoulder and a second shoulder with a side wall, and the side wall of the second shoulder contains one or more depressions, and wherein the depending peripheral skirt has protrusions, and the protrusions of the depending peripheral skirt mate with the depressions on the side wall of the second shoulder of the receptacle and wherein the base portion comprises a platform having a conduit which provides a channel through which the flowable product can flow and wherein the conduit comprises a stop in the form of a fin that extends perpendicularly from the outer surface of the conduit.

82. A container for storing and dispensing flowable products comprising (a) a receptacle for storing the flowable product, and (b) a combination closure and applicator, comprising a base portion, a closure and an applicator which is integral with the receptacle, said closure comprising a top surface, a neck portion, an intermediate platform and a cylindrical portion with threaded engaging means thereon and is operable to open and close the receptacle and said applicator to apply the product directly to the desired surface when placed in contact therewith wherein the base portion comprises a conduit having an inner surface, said inner surface having threaded engaging means, and wherein the threaded engaging means on the cylindrical portion of the closure mate with threaded engaging means on the inner surface of the conduit when the closure is affixed to the base portion.

83. A container for storing and dispensing flowable products comprising (a) a receptacle for storing the flowable product, and (b) a combination closure and applicator comprising a base portion, a closure and an applicator which is integral with the receptacle, said closure operable to open and close the receptacle and said applicator to apply the product directly to the desired surface when placed in contact therewith, wherein the closure comprises a top surface, a neck portion, an intermediate platform and a cylindrical portion and an orifice and a channel having an inner surface, and at the end of the channel there is a peg suspended from the sides of the channel inner surface, wherein a convex dome is affixed to the neck portion and wherein the base portion comprises a conduit having outer surface and on the outer surface thereof are two parallel ridges having a space there between, and the closure comprises an intermediate platform having two downwardly extending fins, a channel, and a second orifice, and the peg closes the second orifice when the closure is rotated into clockwise direction to cause one of the downwardly extending fins to seat in teh space between the two parallel ridges.

84. The container of claim 83 wherein the peg is suspended from the sides of the channel inner surface by two cross bars.

85. The container of claim 83 wherein an audible click is heard by the consumer when one of the downwardly extending fins is seated in the space between the two parallel ridges.

86. A container for storing and dispensing flowable products comprising (a) a receptacle for storing the flowable product, and (b) a combination closure and applicator comprising a base portion, a closure and an applicator which is integral with the receptacle, said closure operable to open and close the receptacle and said applicator to apply the product directly to the desired surface when placed in contact therewith, wherein the base portion comprises a platform perpendicular to and forming the top surface of the threaded engaging means wherein the platform comprises a conduit and the conduit is perpendicular to the platform and has an inner surface and an outer surface and provides a channel through which the flowable product can flow from the receptacle and the conduit further comprises a stop in the form of a fin that extends perpendicularly from the outer surface thereof.

87. A container for storing and dispensing flowable products comprising (a) a receptacle for storing the flowable product, and (b) a combination closure and applicator comprising a base portion, a closure and an applicator which is integral with the receptacle, said closure operable to open and close the receptacle and said applicator to apply the product directly to the desired surface when placed in contact therewith, wherein the base portion comprises a platform perpendicular to and forming the top surface of the threaded engaging means wherein the platform comprises a conduit and the conduit is perpendicular to the platform and has an inner surface and an outer surface and wherein the platform contains two openings extending through the platform and the openings abut the outer surface of the conduit wherein the conduit is secured to the platform in at least two areas and wherein the base portion further comprises at least one first under surface which forms the interior surface of the areas where the conduit is secured to the platform.

88. A container for storing and dispensing flowable products comprising (a) a receptacle for storing the flowable product, and (b) a combination closure and applicator comprising a base portion, a closure and an applicator which is integral with the receptacle, said closure operable to open and close the receptacle and said applicator to apply the product directly to the desired surface when placed in contact therewith, wherein the closure comprises a top surface containing an orifice and a channel and the top surface of the closure contains four reservoirs for containing a flowable product.

89. A container for storing and dispensing flowable products comprising (a) a receptacle for storing the flowable product, and (b) a combination closure and applicator comprising a base portion, a closure and an applicator which is integral with the receptacle, said closure operable to open and close the receptacle and said applicator to apply the product directly to the desired surface when placed in contact therewith, wherein the closure comprises a neck portion with one or more extending walls and a top surface which is a convex dome and wherein the applicator is affixed to the convex dome with a circumferential ring having two or more depressions on the inner surface which serve to affix or hold the circumferential ring to closure.

90. A container for storing and dispensing flowable products comprising (a) a receptacle for storing the flowable product, and (b) a combination closure and applicator comprising a base portion, a closure and an applicator which is integral with the receptacle, said closure operable to open and close the receptacle and said applicator to apply the product directly to the desired surface when placed in contact therewith, wherein the closure comprises a top surface containing an orifice and a channel and the top surface of the closure contains a plurality of reservoirs for containing the flowable product and wherein the top surface of the closure is a convex dome which is affixed to a neck portion and the neck portion comprises a lower edge and affixed to the lower edge is an intermediate platform.

91. The container of claim 90 wherein the top surface of the closure contains four reservoirs.

* * * * *

UNITED STATES PATENT AND TRADEMARK OFFICE

CERTIFICATE OF CORRECTION

PATENT NO. : 6,981,814 B2
DATED : January 3, 2006
INVENTOR(S) : Geardino et al.

It is certified that error appears in the above-identified patent and that said Letters Patent is hereby corrected as shown below:

Title page,
Item [73], Assignee, change "Redlon" to -- Revlon --.

Signed and Sealed this

Seventh Day of March, 2006

JON W. DUDAS
*Director of the United States Patent and Trademark Office*